US008598100B2

(12) United States Patent
Koshima et al.

(10) Patent No.: US 8,598,100 B2
(45) **Date of Patent: *Dec. 3, 2013**

(54) LUBRICATING OIL ADDITIVE AND LUBRICATING OIL COMPOSITION

(75) Inventors: Hiroaki Koshima, Sodegaura (JP); Shinichi Yanagi, Sodegaura (JP); Keiichi Narita, Ichihara (JP); Hidetoshi Koga, Ichihara (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 1639 days.

This patent is subject to a terminal disclaimer.

(21) Appl. No.: 10/561,368

(22) PCT Filed: Jun. 23, 2004

(86) PCT No.: PCT/JP2004/009230

§ 371 (c)(1),
(2), (4) Date: Dec. 20, 2005

(87) PCT Pub. No.: WO2004/113477

PCT Pub. Date: Dec. 29, 2004

(65) Prior Publication Data

US 2006/0160709 A1 Jul. 20, 2006

(30) Foreign Application Priority Data

Jun. 23, 2003 (JP) ..... 2003-178092

(51) Int. Cl.
*C10M 133/56* (2006.01)

(52) U.S. Cl.
USPC ..... 508/291; 508/192

(58) Field of Classification Search
USPC ..... 508/192, 291
See application file for complete search history.

(56) References Cited

U.S. PATENT DOCUMENTS

| | | | | | |
|---|---|---|---|---|---|
| 3,405,065 | A | * | 10/1968 | Goodwine, Jr. | 508/295 |
| 3,623,985 | A | | 11/1971 | Hendrickson | |
| 4,863,487 | A | * | 9/1989 | Meyer et al. | 44/335 |
| 5,441,656 | A | * | 8/1995 | Ohtani et al. | 508/558 |
| 5,750,476 | A | | 5/1998 | Nibert et al. | |
| 5,789,356 | A | * | 8/1998 | Tiffany, III | 508/293 |
| 6,133,210 | A | * | 10/2000 | Tipton | 508/469 |
| 6,906,191 | B2 | * | 6/2005 | Koshima et al. | 544/374 |
| 2003/0018198 | A1 | | 1/2003 | Koshima et al. | |
| 2004/0102338 | A1 | * | 5/2004 | Harrison et al. | 508/291 |
| 2005/0181957 | A1 | | 8/2005 | Koshima et al. | |

FOREIGN PATENT DOCUMENTS

| | | | |
|---|---|---|---|
| EP | 1243609 | A1 * | 9/2002 |
| EP | 1 508 610 | A1 | 2/2005 |
| JP | 49-22388 | | 2/1974 |
| JP | 3-502114 | | 5/1991 |
| JP | 4-345690 | | 12/1992 |

* cited by examiner

*Primary Examiner* — Jim Goloboy
(74) *Attorney, Agent, or Firm* — Oblon, Spivak, McClelland, Maier & Neustadt, L.L.P.

(57) ABSTRACT

A lubricant additive which comprises a succinimide compound or a boronization product thereof is advantageously used for preparation of a lubricant composition which can maintain the property of anti-shudder for a long time without decreasing the transmission torque capacity or the friction coefficient between metals. The succinimide compound is obtained by reacting (a) succinic acid substituted with an alkenyl or alkyl group having 6 to 30 carbon atoms or an anhydride thereof with (b) a polyalkylenepolyamine comprising a polyalkylenepolyamine having a ring structure at an end in an amount of at least 5% by mole of the entire amount of the polyalkylenepolyamine and is represented by following general formula (1):

(1)

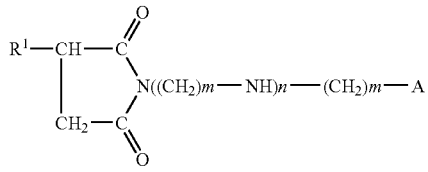

(In the formula, $R^1$ represents an alkenyl or alkyl group having 6 to 30 carbon atoms, m represents an integer of 2 to 4, n represents an integer of 0 to 3, and A represents the ring structure in the polyalkylenepolyamine having a ring structure at an end or a mixed structure comprising the ring structure and an amino group).

13 Claims, No Drawings

LUBRICATING OIL ADDITIVE AND LUBRICATING OIL COMPOSITION

TECHNICAL FIELD

The present invention relates to a lubricant additive and a lubricant composition comprising the lubricant additive and, more particularly, to a lubricant additive providing a long life of anti-shudder of lock-up clutches in torque converters, a great transmission torque capacity of transmission clutches and a great friction coefficient between metals and a lubricant composition comprising the lubricant additive. The lubricant composition of the present invention is advantageously used as the lubricant composition for driving systems, the lubricant composition for automatic transmissions and the lubricant composition for continuous variable transmissions which can maintain the long life of anti-shudder, the great transmission torque capacity and the great friction coefficient between metals.

BACKGROUND ART

Many of the automatic transmissions of automobiles are constituted with a torque converter, a wet type clutch, gears, bearings and a hydraulic control mechanism. In the torque converter, the medium which works for transfer of power is an automatic transmission fluid. The engine torque is transferred to the transmission via the automatic transmission fluid.

Energy saving is greatly required in recent years, and an increase in the efficiency of power transfer is required for the transmission. To satisfy the requirement, a lock-up clutch effective for improving the fuel economy is disposed at the inside of the torque converter in the automatic transmission. The lock-up clutch transfers the engine torque directly to the automatic transmission mechanism in accordance with the driving condition of the automobile. The efficiency of the torque converter can be improved by switching between the driving through the torque converter and the direct driving at the optimal times.

However, the lock-up clutch has not been used in the low speed range since the ride becomes poor due to fluctuations in the torque of the engine when the lock-up clutch is used in the low speed range. Therefore, in the low speed range, a loss in the power transfer arises during the torque transfer between the rotation of the engine and the rotation of the transmission by the torque converter. To decrease the loss in the power transfer and improve the fuel economy, a slip control method for absorbing the fluctuations in the torque of the engine during the use of the lock-up clutch in the low speed range is recently introduced. However, the slip control method has a problem in that abnormal vibration of the body, which is called shudder, takes place at the faces of friction in the lock-up clutch. To prevent the shudder, a lubricant composition which exhibits an improved μ-V property (μ: the friction coefficient; V: the slip speed) so that the friction coefficient increases as the slip speed increases and, therefore, exhibits an excellent property for anti-shudder, is required.

The transmission has a wet type clutch, and transmission shock takes place when the friction property of the clutch in the transmission is poor. Therefore, a lubricant composition exhibiting an excellent friction property is required so that the transmission shock is decreased.

Esters of phosphoric acid, amides of fatty acids, esters of fatty acids and amines have heretofore been used as the friction modifier to improve the property for anti-shudder and the friction property. However, friction coefficient decreases and the transmission torque capacity becomes insufficient when the friction modifier is added in a great amount. Development of a lubricant for transmissions which can maintain the mechanism of anti-shudder without decreasing the transmission torque capacity is desired.

In the automatic transmission, a one-way clutch is used for the stator and the transmission clutch in the torque converter in many cases. The one-way clutch is fixed by the friction force between metals of balls and rollers disposed at the inside, and the rotation in the direction opposite to the direction of rotation is prevented. However, when the friction modifier is added in a great amount, there is the possibility that the friction coefficient decreases, and the one-way clutch makes slipping. Therefore, a lubricant for transmissions which can maintain the friction coefficient between metals is necessary.

As the lubricant composition for automatic transmissions, for example, a composition containing a bisimide compound having a hydrocarbon group having at least 5 carbon atoms, which can improve the property of anti-shudder in the transmission for automobiles equipped with the slip control mechanism even when the lockup mechanism is used in the low speed range, is disclosed (for example, Japanese Patent Application Laid-Open No. Heisei 9(1997)-202890). A lubricant composition containing a bisimide compound having a hydrocarbon group having 8 to 30 carbon atoms and an ashless dispersant modified with boron, which can maintain the property of anti-shudder in the low speed range and can prevent cleavage of the clutch, is disclosed (for example, Japanese Patent Application Laid-Open No. 2001-288489). A lubricant composition containing a bisimide and a monoimide having a hydrocarbon group having 8 to 30 carbon atoms, which maintains the property of anti-shudder in the low speed range and exhibits a great torque capacity and an excellent transmission range of the wet type clutch, is disclosed (for example, Japanese Patent Application Laid-Open No. 2002-105478). However, since these lubricant compositions do not exhibit sufficient stability, there is a limit for maintaining the property of anti-shudder. Therefore, a lubricant additive and a lubricant composition which exhibits a more excellent property of anti-shudder is strongly desired.

DISCLOSURE OF THE INVENTION

The present invention has been made under the above circumstances and has an object of providing a lubricant additive for preparing a lubricant composition which can maintain the property of anti-shudder for a long time without decreasing the transmission torque capacity or the friction coefficient between metals and a lubricant composition obtained by using the lubricant additive.

As the result of intensive studies by the present inventors to achieve the above object, it was found that the object could be achieved with a lubricant additive comprising a succinimide compound obtained by reacting a specific succinic acid or an anhydride thereof with a specific polyalkylenepolyamine or a boronization product of the succinimide compound. The present invention has been completed based on the knowledge.

The present invention is summarized as follows:

1. A lubricant additive which comprises a succinimide compound or a boronization product thereof, wherein the succinimide compound is obtained by reacting (a) succinic acid substituted with an alkenyl or alkyl group having 6 to 30 carbon atoms or an anhydride thereof with (b) a polyalkylenepolyamine comprising a polyalkylenepolyamine having a ring structure at an end in an amount of at least 5% by mole of an entire amount of the polyalkylenepolyamine and is represented by following general formula (1):

(1)

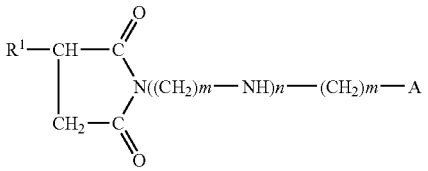

wherein $R^1$ represents an alkenyl or alkyl group having 6 to 30 carbon atoms, m represents an integer of 2 to 4, n represents an integer of 0 to 3, and A represents the ring structure in the polyalkylenepolyamine having a ring structure at an end or a mixed structure comprising the ring structure and an amino group.

2. A lubricant additive described in 1, wherein the ring structure in the polyalkylenepolyamine having a ring structure at an end is a ring structure represented by following general formula (2):

(2)

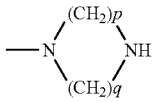

wherein p and q each represent an integer of 2 to 4.

3. A lubricant additive described in 1, wherein the polyalkylenepolyamine having a ring structure at an end is aminoethylpiperazine.

4. A lubricant additive described in 1, wherein the polyalkylenepolyamine comprises the polyalkylenepolyamine having a ring structure at an end in an amount of 10 to 100% by mole of an entire amount of the polyalkylenepolyamine.

5. A lubricant additive described in 4, wherein the polyalkylenepolyamine comprises the polyalkylenepolyamine having a ring structure at an end in an amount of 20 to 100% by mole of an entire amount of the polyalkylenepolyamine.

6. A lubricant additive described in 1, wherein the succinimide compound or the boronization product thereof is a compound having a linear alkenyl or alkyl group having 6 to 30 carbon atoms which is bonded at an end portion of the group or at an intermediate portion of the group.

7. A lubricant additive described in 1, which further comprises a succinimide compound having a number-average molecular weight of 500 to 5,000 and substituted with an alkenyl or alkyl group or a boronization product of the succinimide compound.

8. A lubricant composition comprising a lubricant additive described in any one of 1 to 7.

9. A lubricant composition described in 8, which is a lubricant composition for driving systems.

10. A lubricant composition described in 8, which is a lubricant composition for automatic transmissions or a lubricant composition for continuous variable transmissions.

THE MOST PREFERRED EMBODIMENT TO CARRY OUT THE INVENTION

The succinimide compound used in the present invention is a reaction product of (a) succinic acid substituted with an alkenyl or alkyl group having 6 to 30 carbon atoms or an anhydride thereof, i.e., an alkenylsuccinic acid, an alkylsuccinic acid, an alkenylsuccinic anhydride or an alkylsuccinic anhydride, with (b) a polyalkylenepolyamine comprising a polyalkylenepolyamine having a ring structure at an end in an amount of at least 5% by mole of the entire amount of the polyalkylenepolyamine. When the number of carbon atom in the alkenyl group or the alkyl group in component (a) is smaller than 6, there is the possibility that the succinimide compound or the boronization product of thereof as the above reaction product is not sufficiently dissolved into the base oil of the lubricant. When the number of carbon atom in the alkenyl group or the alkyl group in component (a) is smaller than 6 or exceeds 30, the compound having the sufficient life of anti-shudder cannot be obtained. It is preferable that the alkenyl group or the alkyl group has 12 to 24 carbon atoms. Examples of the alkenyl group having 6 to 30 carbon atoms include hexenyl group, octenyl group, decenyl group, dodecenyl group, tetradecenyl group, hexadecenyl group and octadecenyl group. Examples of the alkyl group having 6 to 30 carbon atoms include hexyl group, octyl group, decyl group, dodecyl group, tetradecyl group, hexadecyl group, octadecyl group, eicosyl group and tetracosyl group. The alkenyl group and the alkyl group may be linear or branched. The alkenyl group and the alkyl group are preferably an alkenyl group and an alkyl group, respectively, which are linear and have 6 to 30 carbon atoms and more preferably an alkenyl group and an alkyl group, respectively, which are linear and have 12 to 24 carbon atoms.

The polyalkylenepolyamine of component (b) may comprise the polyalkylenepolyamine having a ring structure at an end alone or may be a mixture of the polyalkylenepolyamine having a ring structure at an end and a polyalkylenepolyamine having no ring structures at ends. When the amount of the polyalkylenepolyamine having a ring structure at an end is less than 5% by mole of the entire amount of the polyalkylene-polyamine, solubility of the formed alkenylsuccinimide compound into an oil such as a lubricant becomes markedly poor, and the heat resistance, the oxidation stability and the property of anti-shudder which are the object of the present invention become insufficient. To further improve the heat resistance, the oxidation stability and the property of anti-shudder, the amount of the polyalkylenepolyamine having a ring structure at an end is preferably at least 10% by mole and more preferably at least 20% by mole.

As the ring structure in the polyalkylenepolyamine having a ring structure at an end, a ring structure represented by the following general formula (2):

(2)

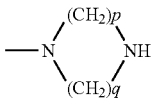

wherein p and q each represent an integer of 2 to 4, is preferable. Among the compounds represented by the above general formula, compounds represented by the above general formula in which both p and q represent 2, i.e., piperazinyl group, is preferable. Examples of the polyalkylenepolyamine having a ring structure at an end include aminoalkyl-piperazines having the piperazinyl structure at an end such as aminoethylpiperazine, aminopropylpiperazine, aminobutylpiperazine, amino(diethyldiamino)piperazine and amino(dipropyldiamino)piperazine. Among these compounds, aminoethylpiperazine is preferable since this compound is easily available. The polyalkylenepolyamine having no ring structures at ends include acyclic polyalkylenepolyamines having no ring structures and polyalkylenepolyamines having a ring structure at a position other than an end. Examples of the acyclic polyalkylene-polyamine include ethylenediamine, diethylenetriamine, triethylene-tetramine and tetraethylenepentamine. Examples of the polyalkylene-polyamine having a ring structure at a position other than an end include di(aminoalkyl)piperazines such as di(aminoethyl)piperazine and di(aminopropyl)piperazine.

The succinimide compound used in the present invention can be obtained by reacting component (a) and component (b) described above in relative amounts such that (a):(b), i.e., the ratio of the amount by mole of component (a) to the amount by mole of component (b), is in the range of 1:10 to 10:1 and preferably in the range of 1:2 to 2:1. The reaction temperature is about 50 to 250° C. and preferably about 140 to 200° C. The reaction pressure is preferably 0.1 to 1 MPa(G), and the reaction time is preferably 1 to 10 hours.

Solvents are not particularly necessary, but a solvent may be used. When a solvent is used, a solvent having a boiling point of 140 to 150° C. such as toluene and xylene is preferable.

When the solvent is used, the concentrations of the raw materials are not particularly limited and can be selected in the range up to the concentration of saturation. It is preferable that the concentration is 0.1 to 10 moles/liter.

In accordance with the reaction described above, the succinimide compound represented by following general formula (1):

(1)

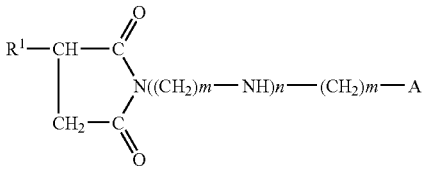

wherein $R^1$ represents an alkenyl or alkyl group having 6 to 30 carbon atoms, m represents an integer of 2 to 4, n represents an integer of 0 to 3, and A represents the ring structure in the polyalkylenepolyamine having a ring structure at an end or a mixed structure comprising the ring structure and an amino group, can be obtained. When 100% by mole of the polyalkylenepolyamine having a ring structure at an end is used as the above polyalkylenepolyamine, the obtained succinimide compound is a compound represented by general formula (1) in which A represents the ring structure. For example, when a polyalkylenepolyamine having the ring structure represented by general formula (2) at an end is used, A represents the ring structure represented by general formula (2). When the above polyalkylenepolyamine is a mixture of a compound having the ring structure at an end and a compound having no ring structures at ends, the obtained succinimide compound is a mixture of a compound represented by general formula (1) in which A represents the ring structure and a compound represented by general formula (1) in which A represents an amino group.

Examples of the alkenyl group and the alkyl group which are represented by $R^1$ include the same groups as those described above as the examples of the alkenyl and alkyl groups having 6 to 30 carbon atoms. Linear alkenyl groups and linear alkyl groups are preferable. The linear alkenyl group and the linear alkyl group may be bonded to the carbon atom at an end portion of the group or at an intermediate portion of the group. m represents an integer of 2 to 4. When m represents an integer greater than 4, there is the possibility that the life of anti-shudder and the torque capacity decrease. n represents an integer of 0 to 3. When n represents an integer greater than 3, not only the heat resistance, the oxidation stability, the life of anti-shudder and the torque capacity decrease, but also the succinimide compound is not sufficiently dissolved into the base oil of the lubricant due to an excessively great polarity.

The boronization product of the succinimide compound used in the present invention is obtained by reacting the succinimide compound obtained as described above with (c) a compound having boron atom in an amount such that the ratio of the amount by mole of the compound having boron atom to the amount by mole of the polyalkylenepolyamine is 1:0.01 to 10 and preferably 1:0.05 to 5. Examples of the compound having boron atom of component (c) include boron oxide, boron halides, boric acid, boric acid anhydride and esters of boric acid. The reaction with component (c) is conducted at about 50 to 250° C. and preferably 100 to 200° C. A solvent, for example, an organic solvent such as a hydrocarbon oil, may be used for the reaction.

The succinimide compound and the boronization product thereof described above have a base number (in accordance with the hydrochloric acid method) of 50 mg/KOH or greater and work as the detergent-dispersant.

The lubricant additive of the present invention may also be a lubricant additive prepared by adding a succinimide compound having a number-average molecular weight of 500 to 5,000 and substituted with an alkenyl group or an alkyl group or a boronization product of the succinimide compound [component (B)] to the above succinimide compound or the above boronization product thereof [component (A)]. As component (B), a succinimide compound represented by general formula (1), in which $R^1$ represents an alkenyl or alkyl group having 30 to 300 carbon atoms, m represents an integer of 2 to 4, n represents an integer of 0 to 6 and A represents a polyalkylenepolyamine having a ring structure, an amino group having no ring structures or a mixed structure comprising the ring structure and the amino group, and boronization products of the succinimide compound are preferable. The amount of component (B) is preferably 1,000 parts by mass or less and more preferably 10 to 1,000 parts by mass per 100 parts by mass of component (A). When the amount of component (B) exceeds 1,000 parts by mass, the effect of providing the long life of anti-shudder and the great torque capacity decrease.

The lubricant composition can be prepared by adding 0.1 to 30% by mass of the lubricant additive of the present invention to a mineral oil or a synthetic oil used as the base oil of the lubricant. It is preferable that the amount of the addition is in the range of 0.1 to 10% by mass. A fuel oil composition can be prepared by adding 0.001 to 1% by mass of the lubricant composition of the present invention to a fuel oil.

The mineral oil and the synthetic oil used as the base oil of the lubricant are not particularly limited, and mineral oils and synthetic oils conventionally used as the base oil of lubricant for driving systems can be used. It is preferable that the base oil has a kinematic viscosity in the range of 2 to 35 $mm^2/s$ and more preferably in the range of 3 to 25 $mm^2/s$ at 100° C. When the kinematic viscosity of the base oil exceeds 35 $mm^2/s$, there is the possibility that the fuel economy decreases. When the kinematic viscosity of the base oil is smaller than 2 $mm^2/s$, there is the possibility that the lubricating property decreases, and consumption of the oil increases due to great volatility. Thus, a kinematic viscosity outside the above range is not preferable. The pour point which is the index of fluidity of the base oil at low temperatures is not particularly limited. In general, a pour point of −10° C. or lower is preferable.

Various mineral oils and synthetic oils are available, and a suitable oil can be selected from these oils. Examples of the mineral oil include paraffinic mineral oils, naphthenic mineral oils and intermediate mineral oils. Specific examples of the mineral oil include light neutral oil, medium neutral oil, heavy neutral oil and bright stock, which are obtained by the purification with a solvent or the purification by hydrogenation.

Examples of the synthetic oil include poly-α-olefins, α-olefin copolymers, polybutene, alkylbenzenes, polyol esters, esters of dibasic acids, esters of polyhydric alcohols, polyoxyalkylene glycols, polyoxy-alkylene glycol esters and polyoxyalkylene glycol ethers. The above base oil may be used singly or in combination of two or more. The mineral oil and the synthetic oil may be used in combination.

Examples of the fuel oil include gasoline, kerosene and gas oil. Oils obtained by purification in accordance with any process such as the purification with a solvent, the purification by hydrogenation and the purification by hydrocracking may be used. The lubricant composition may further comprise additives conventionally used for lubricants such as antioxidants, antiwear agents, other detergent-dispersants, viscosity index improvers and pour point improvers as long as the effects of the succinimide compound or the boronization product thereof are not adversely affected.

Examples of the antioxidant include amine-based antioxidants such as alkylated diphenylamines, phenyl-α-naphthylamine and alkylated α-naphthylamines; and phenol-based antioxidants such as 2,6-di-t-butyl-4-methylphenol and 4,4'-methylenebis(2,6-di-t-butylphenol). In general, the antioxidant is used in an amount in the range of 0.05 to 2% by mass.

Examples of the antiwear agent include organomolybdenum compounds such as MoDTP and MoDTC; organozinc compounds such as ZnDTP; organoboron compounds such as alkylmercaptyl borates; and solid lubricant-based antiwear agents such as graphite, molybdenum sulfide, antimony sulfide, boron compounds and polytetrafluoroethylene. In general, the antiwear agent is used in an amount in the range of 0.1 to 3% by mass.

Examples of the other detergent-dispersant include metal-based detergents. Examples of the metal-based detergent include calcium sulfonate, magnesium sulfonate, barium sulfonate, calcium phenate and barium phenate. In general, the other detergent-dispersant is used in an amount in the range of 0.1 to 5% by mass. Examples of an ashless detergent-dispersant include succinimide-based detergent-dispersants, succinamide-based detergent-dispersants, benzylamine-based detergent-dispersants and ester-based detergent-dispersant. In general, the ashless detergent-dispersant is used in an amount in the range of 0.5 to 7% by mass.

Examples of the viscosity index improver include polymethacrylate-based improvers, polyisobutylene-based improvers, ethylene-propylene copolymer-based improvers and hydrogenated styrene-butadiene copolymer-based improvers. In general, the viscosity index improver is used in an amount in the range of 0.5 to 35% by mass.

The lubricant composition of the present invention is advantageously used as the lubricant composition for driving systems, the lubricant compositions for automatic transmissions and the lubricant composition for continuous variable transmissions.

The present invention will be described more specifically with reference to examples in the following. However, the present invention is not limited to the examples.

Example 1

Into a 200 ml separable flask, 12.9 g (0.1 mole) of aminoethylpiperazine (AEP) dissolved in 20 ml of xylene was placed. The flask was purged with the nitrogen gas, and the temperature was kept at 50° C. Into the flask, 32.4 g (0.1 mole) of hexadecenylsuccinic anhydride (HDSA) dissolved in 50 ml of xylene and 15.0 g of a mineral oil corresponding to 150 neutral which were added dropwise under sufficient stirring. The temperature of the reaction mixture was raised to about 80° C. due to the heat of the reaction. The reaction was allowed to proceed at about 150° C. for 4 hours while water was removed under a stream of the nitrogen gas. Then, the unreacted AEP, water formed by the reaction and xylene were removed by distillation under a reduced pressure. After the temperature was lowered, the reaction mixture was filtered. The yield of the obtained hexadecenylsuccimide was 57 g. The base number (in accordance with the hydrochloric acid method) was 93 mg KOH/g.

Example 2

A reaction was conducted in accordance with the same procedures as those conducted in Example 1 except that a mixture of 10.3 g (0.08 moles) of AEP and 2.1 g (0.02 moles) of diethylenetriamine (DETA) was used in place of 12.9 g (0.1 mole) of AEP. The yield of the obtained hexadecenylsuccimide was 57 g. The base number was 92 mg KOH/g, and the total acid number was 1 mg KOH/g.

Example 3

A reaction was conducted in accordance with the same procedures as those conducted in Example 1 except that a mixture of 6.5 g (0.05 moles) of AEP and 5.2 g (0.05 moles) of DETA was used in place of 12.9 g (0.1 mole) of AEP. The yield of the obtained hexadecenylsuccimide was 58 g. The base number was 91 mg KOH/g.

Example 4

A reaction was conducted in accordance with the same procedures as those conducted in Example 1 except that a mixture of 2.6 g (0.02 moles) of AEP and 8.2 g (0.08 moles) of DETA was used in place of 12.9 g (0.1 mole) of AEP. The yield of the obtained hexadecenylsuccimide was 57 g. The base number was 92 mg KOH/g, and the total acid number was 1 mg KOH/g.

Example 5

A reaction was conducted in accordance with the same procedures as those conducted in Example 1 except that 35.2 g (0.1 mole) of octadecenylsuccinic anhydride (ODSA) was used in place of HDSA. The yield of the obtained octadecenylsuccinimide was 59 g. The base number was 89 mg KOH/g.

Example 6

A reaction was conducted in accordance with the same procedures as those conducted in Example 1 except that a mixture of 6.5 g (0.05 moles) of AEP and 5.2 g (0.05 moles) of DETA was used in place of 12.9 g (0.1 mole) of AEP, and 35.2 g (0.1 mole) of octadecenylsuccinic anhydride (ODSA)

was used in place of HDSA. The yield of the obtained octadecenylsuccinimide was 57 g. The base number was 89 mg KOH/g.

Example 7

A reaction was conducted in accordance with the same procedures as those conducted in Example 1 except that 40.8 g (0.1 mole) of an alkenylsuccinic anhydride (ASA) was used in place of 32.4 g (0.1 mole) of HDSA. The alkenyl group in ASA was composed of groups having 20, 22 and 24 carbon atoms. The yield of the obtained alkenylsuccinimide was 62 g. The base number was 85 mg KOH/g.

Example 8

A reaction was conducted in accordance with the same procedures as those conducted in Example 1 except that a mixture of 6.5 g (0.05 moles) of AEP and 5.2 g (0.05 moles) of DETA was used in place of 12.9 g (0.1 mole) of AEP, and 40.8 g (0.1 mole) of an alkenylsuccinic anhydride (ASA) was used in place of HDSA. The alkenyl group in ASA was composed of groups having 20, 22 and 24 carbon atoms. The yield of the obtained alkenylsuccinimide was 62 g. The base number was 84 mg KOH/g.

Example 9

In a 200 ml separable flask, 50 g of hexadecenylsuccinimide obtained in Example 1 and 1.7 g of boric acid were placed, and the reaction was allowed to proceed at 150° C. for 4 hours under a stream of the nitrogen gas. Water formed by the reaction was removed by distillation under a reduced pressure at 150° C., and the obtained residue was filtered. The yield of the product was 48 g. The base number was 88 mg KOH/g, and the content of boron was 0.5% by mass.

Example 10

Hexadecenylsuccinimide obtained in Example 1 was used as component (A), and polybutenylsuccinimide prepared as described in the following was used as component (B). Into a 1 liter autoclave, 1,100 g of polybutene (Mn: 980), 6.4 g (0.021 moles) of cetyl bromide and 115 g (1.2 moles) of maleic anhydride were placed. The autoclave was purged with the nitrogen gas, and the reaction was allowed to proceed at 240° C. for 5 hours. Then, the temperature was lowered to 215° C., and the unreacted maleic anhydride and cetyl bromide were removed by distillation under a reduced pressure. The temperature was lowered to 140° C., and the obtained residue was filtered. The yield of the obtained polybutenylsuccinic anhydride was 1,100 g. The saponification value was 80 mg KOH/g.

Into a 500 ml separable flask, 100 g of the obtained polybutenylsuccinic anhydride, 4.4 g (0.034 moles) of AEP, 5.0 g (0.034 moles) of triethylenetetramine (TETA) and 50 g of a mineral oil were placed, and the reaction was allowed to proceed at 150° C. for 2 hours under a stream of the nitrogen gas. After the reaction was completed, the temperature was raised to 200° C., and the unreacted AEP and TETA and water formed by the reaction were removed by distillation under a reduced pressure. After the temperature was lowered to 140° C., the residue was filtered, and polybutenylsuccinimide was obtained. The yield was 156 g, and the base number was 45 mg KOH/g.

Component (A) and component (B) in relative amounts by mass of 1:1 were mixed together, and a mixed succinimide was obtained. The base number was 68 mg KOH/g.

Example 11

A reaction was conducted in accordance with the same procedures as those conducted in Example 1 except that 35.2 g (0.1 mole) of octadecenylsuccinic anhydride (ODSA) was used in place of HDSA, and a mixture of 4.3 g (0.033 moles) of AEP and 3.4 g (0.033 moles) of DETA was used in place of 12.9 g (0.1 mole) of AEP. The yield of the obtained octadecenylsuccinimide was 56 g. The base number was 42 mg KOH/g.

Example 12

A reaction was conducted in accordance with the same procedures as those conducted in Example 1 except that 35.2 g (0.1 mole) of octadecenylsuccinic anhydride (ODSA) was used in place of HDSA, and a mixture of 1.8 g (0.014 moles) of AEP and 4.3 g (0.042 moles) of DETA was used in place of 12.9 g (0.1 mole) of AEP. The yield of the obtained octadecenylsuccinimide was 55 g. The base number was 37 mg KOH/g.

Example 13

A reaction was conducted in accordance with the same procedures as those conducted in Example 1 except that 40.8 g (0.1 mole) of an alkenylsuccinic anhydride (ASA) was used in place of HDSA, and a mixture of 1.8 g (0.014 moles) of AEP and 4.3 g (0.042 moles) of DETA was used in place of 12.9 g (0.1 mole) of AEP. The alkenyl group in ASA was composed of groups having 20, 22 and 24 carbon atoms. The yield of the obtained octadecenylsuccinimide was 59 g. The base number was 36 mg KOH/g.

Example 14

In a 200 ml separable flask, 50 g of the alkenylsuccinimide obtained in Example 13 and 1.7 g of boric acid were placed, and the reaction was allowed to proceed at 150° C. for 4 hours under a stream of the nitrogen gas. Water formed by the reaction was removed by distillation under a reduced pressure at 150° C., and the obtained residue was filtered. The yield of the product was 48 g. The base number was 34 mg KOH/g and the content of boron was 0.6% by mass.

Examples 15 to 28

To a mineral oil of the 100 neutral fraction (a 100N base oil), 0.5% by mass of the alkenylsuccinimide obtained in one of Examples 1 to 9 and 11 to 14 or the mixed succinimide obtained in Example 10, a metal-based detergent (calcium sulfonate), an antiwear agent (an ester of phosphoric acid) and a viscosity index improver (a polymethacrylate) were mixed. Lubricant compositions were prepared in this manner. The properties of the prepared lubricant compositions were evaluated in accordance with the following test methods. The results are shown in Tables 1 and 2.

<Test Methods>

(1) Test of the Property of Anti-Shudder of Automatic Transmission Fluid

The test was conducted in accordance with the method of JASO M349-98 under the following condition. The μ-V property was measured every 24 hours, and the time when the μ-ratio=(μ50−μ1)/(50−V1) turned to a negative value was used as the life of anti-shudder. μ50 represents the friction coefficient at the rotational speed of 50 rpm, μ1 represents the friction coefficient at the rotational speed of 1 rpm, V50 represents the slip speed (the unit: m/s) at the rotational speed of 50 rpm, and V1 represents the slip speed at the rotational speed of 1 rpm.

Test apparatus: low speed slip tester
friction plate: ZDR522.OK
steel plate: FZ132-8-Y1
Condition of Endurance Test:
oil temperature: 120° C.
surface pressure of pressing: 1 MPa
speed: 0.9 m/s (2) Test of the Friction Property of Automatic Transmission Fluid The dynamic friction test and the static friction test were conducted in accordance with the method of JASO M348-958 under the following condition. Sliding was started 60 seconds after the dynamic friction test was completed. The maximum torque immediately after the start of the sliding (μs) and the torque two seconds after the start of the sliding (μt) were measured, and the minimum value of μt during the test cycles was used as the transmission torque capacity.

Test apparatus: SAE No. 2 tester
friction plate: FZ127-24-Y1
steel plate: FZ132-8-Y1
[Dynamic Friction Test]
moment of inertia of the inertia disk: 0.343 kg $m^2$
rotational speed of test: 3,600 rpm
oil temperature: 100° C.
pressing load: 785 kPa
test cycle: 30 seconds/cycle
time before increase in the pressing pressure: 0.1 to 0.5 seconds
time of application of pressure: 2 seconds
number of cycles: 5,000 times
[Static Friction Test]
slide speed: 0.7 m/s
oil temperature: 100° C.
pressing load: 785 kPa
test time: for 3 seconds after the start of rotation
time of start of the test: sliding started 60 seconds after the dynamic test was completed
test cycle: 1, 5, 10, 20, 50, 100, 200, 500, 1,000, 2,000, 3,000, 4,000, 5,000

(3) LFW-1 Friction Test

The test was conducted under the following condition, and the friction coefficient 5 minutes after the start of the test was used as the friction coefficient between metals.

Test apparatus: LFW-1 friction tester
ring: S10
block: H60
Test condition: load: 1,130 N
slip speed: 0.5 m/s
oil temperature: 100° C.

Comparative Example 1

Into a 1 liter autoclave, 1,100 g of polybutene (Mn: 980), 6.4 g (0.021 moles) of cetyl bromide and 115 g (1.2 moles) of maleic anhydride were placed, and the flask was purged with the nitrogen gas. The reaction was allowed to proceed at 240° C. for 5 hours. The temperature was lowered to 215° C., and the unreacted maleic anhydride and cetyl bromide were removed by distillation under a reduced pressure. The temperature was lowered to 140° C., and the obtained residue was filtered. The yield of the obtained polybutenylsuccinic anhydride was 1,100 g, and the saponification value was 80 mg KOH/g. Into a 500 ml separable flask, 100 g of the obtained polybutenylsuccinic anhydride, 9.9 g (0.068 moles) of triethylenetetramine (TETA) and 50 g of a mineral oil were placed, and the reaction was allowed to proceed at 150° C. for 2 hours under a stream of the nitrogen gas. The temperature was raised to 200° C., and the unreacted TETA and water formed by the reaction were removed by distillation under a reduced pressure. The temperature was lowered to 140° C., and the obtained residue was filtered. The yield of the obtained polybutenylsuccinimide was 153 g, and the base number was 44 mg KOH/g.

Comparative Example 2

A reaction was conducted in accordance with the same procedures as those conducted in Example 1 except that 10.3 g (0.1 mole) of DETA was used in place of 12.9 g (0.1 mole) of AEP. The obtained product was a semisolid substance and was not dissolved in a mineral oil of the 100 neutral fraction (a 100N base oil).

Comparative Examples 3 to 5

To a mineral oil of the 100 neutral fraction (a 100N base oil), polybutenylsuccinimide obtained in Comparative Example 1, 0.5% by mass of a commercial isostearic acid amide or a commercial oleic acid monoglyceride and the same metal-based detergent, antiwear agent and viscosity index improver as those used above were added. Lubricant compositions were prepared in this manner. The properties of the prepared lubricant compositions were evaluated in accordance with the tests described above. The results are shown in Table 3.

TABLE 1

| Example | 15 | 16 | 17 | 18 | 19 | 20 | 21 |
|---|---|---|---|---|---|---|---|
| Composition (% by mass) | | | | | | | |
| 100 N base oil | 90 | 90 | 90 | 90 | 90 | 90 | 90 |
| metal-based detergent | 0.5 | 0.5 | 0.5 | 0.5 | 0.5 | 0.5 | 0.5 |
| antiwear agent | 0.5 | 0.5 | 0.5 | 0.5 | 0.5 | 0.5 | 0.5 |
| viscosity index improver | 8.5 | 8.5 | 8.5 | 8.5 | 8.5 | 8.5 | 8.5 |
| compound of Example 1 | 0.5 | | | | | | |
| compound of Example 2 | | 0.5 | | | | | |
| compound of Example 3 | | | 0.5 | | | | |
| compound of Example 4 | | | | 0.5 | | | |
| compound of Example 5 | | | | | 0.5 | | |

TABLE 1-continued

| Example | 15 | 16 | 17 | 18 | 19 | 20 | 21 |
|---|---|---|---|---|---|---|---|
| compound of Example 6 | | | | | | 0.5 | |
| compound of Example 7 | | | | | | | 0.5 |
| Life of anti-shudder (hrs) | 168 | 168 | 168 | 144 | 168 | 168 | 168 |
| Friction coefficient (μt) | 0.125 | 0.124 | 0.123 | 0.124 | 0.126 | 0.125 | 0.125 |
| Friction coefficient between metals | 0.122 | 0.119 | 0.119 | 0.122 | 0.121 | 0.121 | 0.122 |

TABLE 2

| Example | 22 | 23 | 24 | 25 | 26 | 27 | 28 |
|---|---|---|---|---|---|---|---|
| Composition (% by mass) | | | | | | | |
| 100 N base oil | 90 | 90 | 90 | 90 | 90 | 90 | 90 |
| metal based detergent | 0.5 | 0.5 | 0.5 | 0.5 | 0.5 | 0.5 | 0.5 |
| antiwear agent | 0.5 | 0.5 | 0.5 | 0.5 | 0.5 | 0.5 | 0.5 |
| viscosity index improver | 8.5 | 8.5 | 8.5 | 8.5 | 8.5 | 8.5 | 8.5 |
| compound of Example 8 | 0.5 | | | | | | |
| compound of Example 9 | | 0.5 | | | | | |
| compound of Example 10 | | | 0.5 | | | | |
| compound of Example 11 | | | | 0.5 | | | |
| compound of Example 12 | | | | | 0.5 | | |
| compound of Example 13 | | | | | | 0.5 | |
| compound of Example 14 | | | | | | | 0.5 |
| Life of anti-shudder (hrs) | 168 | 168 | 144 | 168 | 168 | 168 | 168 |
| Friction coefficient (μt) | 0.124 | 0.124 | 0.124 | 0.126 | 0.126 | 0.126 | 0.126 |
| Friction coefficient between metals | 0.121 | 0.120 | 0.121 | 0.123 | 0.123 | 0.124 | 0.124 |

TABLE 3

| Comparative Example | 3 | 4 | 5 |
|---|---|---|---|
| Composition (% by mass) | | | |
| 100 N base oil | 90 | 90 | 90 |
| metal based detergent | 0.5 | 0.5 | 0.5 |
| antiwear agent | 0.5 | 0.5 | 0.5 |
| viscosity index improver | 8.5 | 8.5 | 8.5 |
| compound of Comparative Example 1 | 0.5 | | |
| isostearic acid amide | | 0.5 | |
| oleic acid monoglyceride | | | 0.5 |
| Life of anti-shudder (hrs) | 24 | 144 | 48 |
| Friction coefficient (μt) | 0.126 | 0.105 | 0.109 |
| Friction coefficient between metals | 0.121 | 0.104 | 0.108 |

When the results of Examples 15 to 28 shown in Tables 1 and 2 are compared with the results of Comparative Examples 3 to 5 shown in Table 3, it is shown that the lubricant additives of the present invention can be more advantageously used as the lubricant additive since the lubricant compositions comprising the lubricant additive of the present invention had longer lives of anti-shudder in the low speed slip test and greater transmission torque capacities of the transmission clutch than those of conventional compositions (Comparative Examples 3 to 5) while the friction coefficient between metals was maintained. It is estimated that the fuel oil composition comprising the lubricant additive of the present invention exhibits the excellent effects such as the detergence.

INDUSTRIAL APPLICABILITY

In accordance with the present invention, the lubricant additive for preparing a lubricant composition which can maintain the property of anti-shudder for a long time without decreasing the transmission torque capacity or the friction coefficient between metals can be obtained. The lubricant composition comprising the lubricant additive is advantageously used as the lubricant composition for driving systems, the lubricant composition for automatic transmissions and the lubricant composition for continuous variable transmissions which can maintain the long life of anti-shudder, the great transmission torque capacity and the great friction coefficient between metals.

The invention claimed is:

1. A lubricant composition comprising:

a succinimide compound (A), wherein the succinimide compound (A) is represented by formula (1) and is obtained by reacting (a) a succinic acid substituted with a linear alkenyl or alkyl group having 16-30 carbon atoms or an anhydride thereof with (b) a polyalkylenepolyamine comprising 50-100 mole % of a polyalkylenepolyamine having a ring structure at an end, based on an entire amount of the polyalkylenepolyamine (b):

(1)

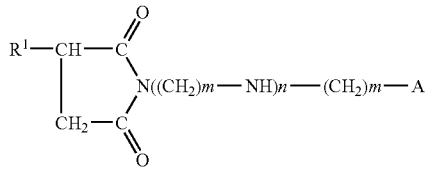

wherein $R^1$ represents a linear alkenyl group having 16-30 carbon atoms or a linear alkyl group having 16-30 carbon atoms, m represents an integer of 2 to 4, n represents an integer of 0 to 3, and A represents the ring structure in the polyalkylenepolyamine having a ring structure at an end or a mixed structure comprising the ring structure and an amino group, wherein the ring structure A in the polyalkylenepolyamine having a ring structure at an end is a ring structure represented by formula (2):

(2)

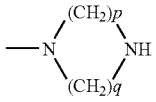

wherein p and q each independently represent an integer of 2 to 4; and a succinimide compound or a boronization product thereof (B) having a number-average molecular weight of 500 to 5,000 and is substituted with an alkenyl or alkyl group, and wherein the succinimide compound or the boronization product thereof (B) is present in the lubricant composition in an amount of 10-1,000 wt. %, based on 100 wt. % of the succinimide compound (A).

2. The lubricant composition according to claim 1, wherein the polyalkylenepolyamine having a ring structure at an end is aminoethylpiperazine.

3. The lubricant composition according to claim 1, wherein the succinic acid or the anhydride thereof (a) is substituted with a linear alkenyl or alkyl group having 18-30 carbon atoms, and wherein $R^1$ represents a linear alkenyl group having 18-30 carbon atoms or a linear alkyl group having 18-30 carbon atoms.

4. A method for reducing shudder in an automatic transmission, said method comprising adding to an automatic transmission fluid the lubricant composition of claim 1.

5. The lubricant composition according to claim 1, wherein the succinimide compound (B) is represented by the following general formula (3) and is obtained by reacting (a) a succinic acid substituted with an alkenyl or alkyl group having 30 to 300 carbon atoms or an anhydride thereof with (b) a polyalkylenepolyamine comprising a polyalkylenepolyamine having at an end thereof a ring structure, an amino group having no ring structure or a mixed structure comprising the ring structure and an amino group:

(3)

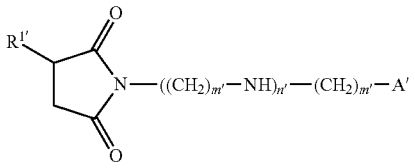

wherein $R^{1'}$ represents an alkenyl or alkyl group having 30 to 300 carbon atoms, m' represents an integer of 2 to 4, n' represents an integer of 0 to 6, and A' represents the ring structure, the amino group having no ring structure or the mixed structure comprising the ring structure and the amino group.

6. The lubricant composition according to claim 1, further comprising one or more additives selected from the group consisting of a metal-based detergent, an antiwear agent and a viscosity index improver.

7. The lubricant composition according to claim 1, wherein the succinic acid or the anhydride thereof (a) is substituted with a linear alkenyl or alkyl group having 24-30 carbon atoms, and wherein $R^1$ represents a linear alkenyl group having 24-30 carbon atoms or a linear alkyl group having 24-30 carbon atoms.

8. The lubricant composition according to claim 1, wherein the succinic acid or the anhydride thereof (a) is substituted with a linear alkenyl or alkyl group having 16-24 carbon atoms, and wherein $R^1$ represents a linear alkenyl group having 16-24 carbon atoms or a linear alkyl group having 16-24 carbon atoms.

9. The lubricant composition according to claim 1, wherein the succinic acid or the anhydride thereof (a) is substituted with a linear alkenyl or alkyl group having 18-24 carbon atoms, and wherein $R^1$ represents a linear alkenyl group having 18-24 carbon atoms or a linear alkyl group having 18-24 carbon atoms.

10. The lubricant composition according to claim 1, wherein the succinic acid or the anhydride thereof (a) is substituted with a linear alkenyl or alkyl group having 16-18 carbon atoms, and wherein $R^1$ represents a linear alkenyl group having 16-18 carbon atoms or a linear alkyl group having 16-18 carbon atoms.

11. The lubricant composition according to claim 1, wherein the polyalkylenepolyamine (b) consists essentially of 80-100 mole % of the polyalkylenepolyamine having a ring structure at an end, based on the entire amount of the polyalkylenepolyamine (b).

12. The lubricant composition according to claim 1, wherein the polyalkylenepolyamine (b) consists essentially of 100 mole % of the polyalkylenepolyamine having a ring structure at an end, based on the entire amount of the polyalkylenepolyamine (b).

13. The method according to claim 4, wherein the automatic transmission is a continuous variable transmission.

* * * * *